US005626078A

United States Patent [19]

Fuchs

[11] Patent Number: 5,626,078

[45] Date of Patent: May 6, 1997

[54] CABLE CAR SYSTEM WITH PASSENGER CARRIERS SUSPENDED FROM A SUSPENSION AND TRACTION CABLE GUIDED AROUND TWO DEFLECTION PULLEYS

[75] Inventor: Elmar B. Fuchs, Schwarzach, Austria

[73] Assignee: Konrad Doppelmayr & Sohn Maschinenfabrik Gesellschaft mbh & Co. KG, Wolfurt, Austria

[21] Appl. No.: 621,574

[22] Filed: Mar. 26, 1996

[30] Foreign Application Priority Data

Apr. 7, 1969 [AT] Austria ..... A622/95

[51] Int. Cl.[6] ..... B61B 1/00

[52] U.S. Cl. ..... 104/28; 104/173.1; 105/341

[58] Field of Search ..... 104/28, 173.1, 104/178, 179, 180; 105/341, 341.5

[56] References Cited

U.S. PATENT DOCUMENTS

| | | | |
|---|---|---|---|
| 5,213,048 | 5/1993 | Kunczynski | 105/341 |
| 5,454,327 | 10/1995 | Goirand | 104/28 |

FOREIGN PATENT DOCUMENTS

| | | | |
|---|---|---|---|
| 3273969 | 12/1991 | Japan | 105/341 |
| 4005161 | 1/1992 | Japan | 105/341 |
| 5112241 | 5/1993 | Japan | 105/341 |

*Primary Examiner*—S. Joseph Morano

*Attorney, Agent, or Firm*—Herbert L. Lerner; Laurence A. Greenberg; Werner H. Stemer

[57] ABSTRACT

A cable car system has a suspension and traction cable carrying passenger carriers, such as lift chairs. The cable is guided around two deflection pulleys. A conveyor device conveys passengers from an entrance gate to a boarding point at which the passengers board to carriers. The opening of the entrance gate and the conveyor device are controlled with a central control unit. The central control unit receives signals from various sensors, such as a signal transducer which is tripped when a passenger carrier passes by, and a speed transducer which measures the speed of the suspension and traction cable. A measuring instrument provides information with regard to the distance traversed by a specific passenger carrier which has tripped the signal transducer. The entrance gate is opened by the central control unit as a function of the output signal of the signal transducer and of the measuring instrument, and further on condition that at least one passenger is present at the gate.

10 Claims, 1 Drawing Sheet

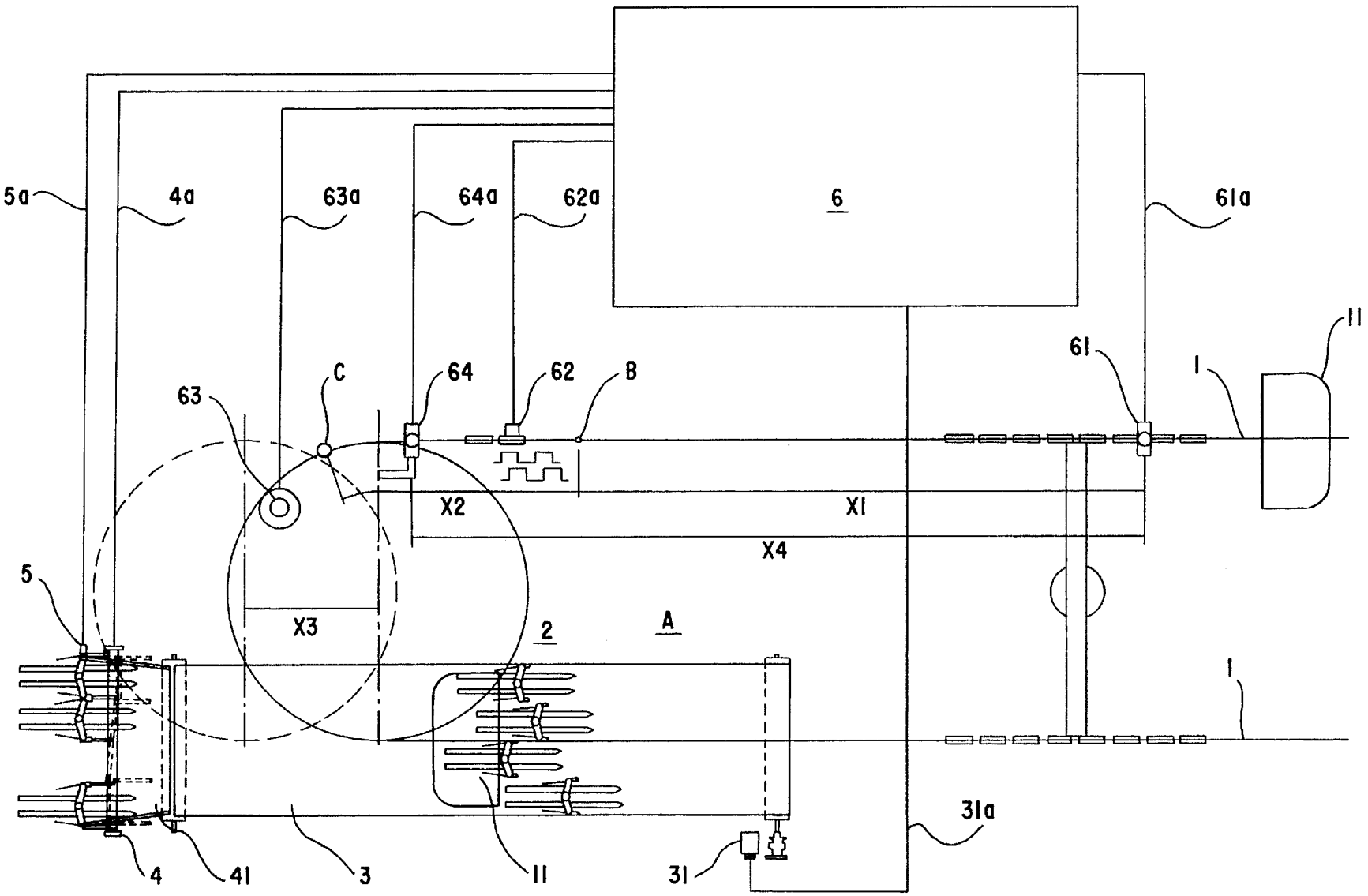
11
61a
1
1
61
6
31a
X1
X4
A
31
B
62a
62
2
11
64a
64
X2
C
63a
X3
3
63
41
4a
4
5a
5

CABLE CAR SYSTEM WITH PASSENGER CARRIERS SUSPENDED FROM A SUSPENSION AND TRACTION CABLE GUIDED AROUND TWO DEFLECTION PULLEYS

BACKGROUND OF THE INVENTION

FIELD OF THE INVENTION

The invention relates to a cable car system in which passenger carriers, such as chairs, are suspended from a suspension and traction cable; the cable is deflected about two deflection pulleys; the system further includes a conveyor device, provided at least at one of the boarding points, through which the passengers are brought to the area in which they board the passenger carriers, with an entrance gate, a central control unit for controlling the entrance gate and the conveyor device; the system also includes a signal transducer, which is trippable when a passenger carrier passes by, and a speed transducer, by which the speed of the suspension and traction cable is detectable, the output signals of the transducers being carried to the central control unit.

In prior art cable car systems of this kind, there is a need to open the entrance gate at exactly the moment at which the conveyor device has conveyed the passengers to the area where they are to board the particular passenger carrier (e.g. a lift chair) as soon as the passenger carrier arrives in that area. The conveyor device is moved at a speed that is substantially slower than that of the passenger carriers. However, since the passenger carriers are secured to the suspension and traction cable at irregular intervals, control of the entrance gate must be performed by whichever passenger carrier is to be used for carrying the passengers just then located in front of the entrance gate.

Since moreover the speed of the suspension and traction cable is not constant but instead varies depending on the technical aspects of the operation, no specific point exists at which the entrance gate must be opened by the passenger carriers entering the station, to allow the passengers to reach the boarding area at the proper time; instead, the location of this point depends on the speed of the suspension and traction cable or the speed of the passenger carriers in an area that can extend over a length of about 100 meters, for instance. The fact that the reaction time of the passengers does not depend on the speed at which the passenger carriers are moved inside the cable car station must also be taken into account.

The point at which the entrance gate must be opened upon the passing of a passenger carrier in order to allow the passengers to board may therefore be located outside the cable car station. Proper and sufficient synchronization and timing of the various operations is often not assured in the prior art systems.

SUMMARY OF THE INVENTION it is accordingly an object of the invention to provide a cable car system with passenger carriers suspended from a suspension and traction cable guided around two deflection pulleys, which overcomes the above-mentioned disadvantages of the heretofore-known devices and methods of this general type and which takes precautions to assure the necessary synchronization between the speed of the passenger carriers, the speed of the conveyor device, and the opening of the entrance gate.

With the foregoing and other objects in view there is provided, in accordance with the invention, a cable car system, comprising: a suspension and traction cable, passenger carriers (e.g. lift chairs) suspended from the cable, a plurality of deflection pulleys about which the cable is deflected, a boarding area defining a boarding point at which passengers board the passenger carriers, a conveyor device disposed at the boarding area for conveying the passengers to the boarding point, an entrance gate disposed at the boarding area, and a central control unit connected to and controlling the entrance gate and the conveyor device; a signal transducer connected to the central control unit for sensing the passenger carriers passing by the signal transducer and for issuing an output signal; a speed transducer connected to the central control unit for detecting a travel speed of the cable and for issuing an output signal; a measuring instrument for detecting a distance traveled by a respective the passenger carrier after having tripped the signal transducer; the central control unit opening the entrance gate as a function of the output signals received from the signal transducer and from the measuring instrument.

In accordance with an added feature of the invention, the measuring instrument is a pulse transducer. And the measuring instrument may double as a speed sensor.

In accordance with an additional feature of the invention, the signal transducer is disposed outside the boarding area, such as on a support of the cable car system outside a station building housing the boarding area.

In accordance with another feature of the invention, a drive motor is provided which drives the conveyor device. The drive motor is controlled by the central control unit.

In accordance with a further feature of the invention, the measuring instrument is a feeler roller contacting the cable.

In accordance with again an added feature of the invention, a first one of the deflection pulleys is disposed in the boarding area, and the cable car system further includes an adjustable clamping carriage for adjusting a position of the first deflection pulley; and in that case, a second signal transducer is adjustably disposed with the clamping carriage. The second signal transducer senses the passenger carriers passing by the second signal transducer and issues a corresponding output signal to the central control unit.

In accordance with a concomitant feature of the invention, the system includes a photoelectric barrier preceding the entrance gate as seen in a direction in which the passengers enter the boarding area, the photoelectric barrier supplying a corresponding signal to the central control unit.

In other words, the invention solves the above-noted objects in that a measuring instrument is provided, by which the distance traversed by the particular passenger carrier which has just tripped the signal transducer is detected. The entrance gate can be opened by the central control unit as a function of the output signals of the signal transducer and of the measuring instrument, which optionally also acts as a speed transducer.

The signal transducer is preferably located outside the station, and it may be located on a support pylon of the cable car system. In a preferred embodiment, the drive motor of the conveyor device is also controllable from the central control unit. The measuring instrument may be embodied by a feeler roller that contacts the suspension and traction cable. A speed transducer may be provided in addition.

Other features which are considered as characteristic for the invention are set forth in the appended claims. Although the invention is illustrated and described herein as embodied in a cable car system with passenger carriers suspended from a suspension and traction cable guided around two deflection pulleys, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings. dr

BRIEF DESCRIPTION OF THE DRAWING

FIG. 1 is a schematic plan view of a station of a cable car system according to the invention.

DESCRIPTION OF THE PREFERRED EMBODIMENTS

Referring now to the sole figure of the drawing in detail, there is seen a suspension and traction cable 1 which is deflected around a deflection pulley 2 in the cable car station. Passenger carriers, such as chairs 11, are secured to the suspension and traction cable 1. A conveyor belt 3 is provided in the area of the suspension and traction cable 1 in which the chairs 11 are to be boarded by the passengers. The conveyor belt 3 is driven by a drive motor 31 at a speed that is less than the speed of the suspension and traction cable 1. The lower speed of the conveyor device 3, by way of example, may be one-third of the traction cable speed. An entrance gate 4 is associated with the conveyor belt 3. The gate 4 must be opened whenever a chair 11 enters the station, to enable the passengers to pass through the entrance gate 4 and to be conveyed on the conveyor belt 3 to the area where they can board the chairs 11. A photoelectric barrier 5 (e.g. a light gate) is located in front of the entrance gate 4.

A central control unit 6 synchronizes and controls the entire system, and in particular the entrance gate 4. The control unit 6 receives the necessary signals from a plurality of transducers (=sensors). The signals provide the information required for the operation. The plurality of transducers includes a signal transducer 61, which is located in the area where the passenger carriers 11 move. The transducer 61 outputs a signal which is fed through a line 61*a* to the central control unit 6, as soon as a passenger carrier 11 moves past it. The signal transducer 61 may be located outside the cable car station, and in particular it can be located on a support of the cable car system.

A feeler roller 62 is also provided, which contacts the suspension and traction cable 1 and by which pulses are output over a line 62*a* to the central control unit 6 upon each revolution of the roller. If a standard roller is used, for instance, then a pulse is output to the central control unit 6 whenever the suspension and traction cable 1 has moved a distance of 75 mm. As a result, the line 62*a* carries a signal representative of the travel distance measurement performed by the feeler roller 62.

A further roller is provided which contacts either the suspension and traction cable 1 or the deflection pulley 2. The further roller is thereby rotated, and it forms a part of a tachometer generator 63. The speed of the suspension and traction cable 2 is thus measured. The output of the tachometer generator 63, which acts as a speed transducer, is likewise supplied, via a line 63*a*, to the central control unit 6. As an alternative, it is also possible to determine the speed of the traction cable 1 by suitably differentiating (over time) the distance signal carried on the line 62*a*. A line 5*a* leads from the photoelectric barrier 5 to the central control unit 6.

A line 4*a* leads from the central control unit 6 to the entrance gate 4, and a line 31*a* leads to the drive motor 31 for the conveyor belt 3.

If moreover the deflection pulley 2 is supported by a clamping carriage which is movable back and forth in the traction direction of the suspension and traction cable 1, then a second signal transducer 64, disposed on the clamping carriage, is provided. The transducer 64 is also activated by a passenger carrier 11 moving past it, and its output is likewise supplied, via a line 64*a*, to the central control unit 6.

The adjustment of the clamping carriage is effected on the basis of the tension of the suspension and traction cable 1, which depends on climatic conditions, the load on the cable car system, and the stretching of the suspension and traction cable 1.

If the suspension and traction cable 1 is moved at maximum speed, then the entrance gate 4 must be opened whenever the chair 11 has moved a distance X1 from the signal transducer 61 to the point B. As soon as the entrance gate 4 is opened, the passengers, after a reaction time which is independent of the speed of the suspension and traction cable 1 has elapsed, move over a ramp 41 onto the conveyor belt 3, from which they are moved, at a speed that is reduced compared to the speed of the suspension and traction cable 1, in the direction of the arrow A until the chair has approached them closely enough from behind that they can board it. The opening of the entrance gate 4 occurs only, however, if passengers are located in front of it, which is monitored by means of the photoelectric barrier 5.

Conversely, if the suspension and traction cable is moving at a lower speed, then the point at which the chair 11 is located when the entrance gate 4 is supposed to be opened is shifted by the distance X2 to a point C.

The distance that has been covered by the chair 11 after passing the first signal transducer 61 is detected by the pulse transducer 62 and is processed in the central control unit 6. The speed of the suspension and traction cable 1 is indicated by the tachometer generator 63 and is likewise processed in the central control unit 6. On the basis of these measured values, the opening of the entrance gate 4 and the speed of the conveyor belt 3 are regulated by the central control unit 6 in such a way that the passengers are in the boarding area when the chair 11 reaches that area.

The mode of operation of the novel cable car system will now be described in further detail:

The instant a chair 11 moves past the first signal transducer 61, the latter outputs a signal over the line 61*a* to the central control unit 6. The central control unit 6 now causes a travel measurement to be made by the pulse transducer 62 in such a way as to determine the position of this chair 11 at that time. The central control unit 6 also calculates the particular point B, in the region of the distance X2, which this chair 11 must pass in order for the entrance gate 4, as a function of the speed of the suspension and traction cable 1 (measured by the tachometer generator 63), to be opened so as to enable the passengers to board this chair 11 in the boarding area of the conveyor belt 3. As soon as the chair 11 has reached this point, which is determined by the travel measurement performed by the pulse transducer 62, and also as soon as the photoelectric barrier 5 indicates, via the line 5*a*, that there is at least one passenger in front of the entrance gate, a signal is output by the central control unit 6 over the line 4*a* to the entrance gate 4, by which this gate is opened.

If the deflection pulley 2 is located on a clamping carriage, by which it is adjustable back and forth in the traction direction of the suspension and traction cable 1, then the passage of a chair 11 past the second signal transducer 64 causes this transducer to output a signal, over the line 64*a* to the central control unit 6, by which signal the location of the deflection pulley 2, which can shift over the distance X3, is likewise supplied to the central control unit 6. As a result, this shifting is likewise taken into account in the opening of the entrance gate 4.

Because of the afore-mentioned configuration, control of the opening of the entrance gate 4 is accomplished in each case by the specific chair 11 that is to be boarded by the passengers located at that time in front of the entrance gate 4. Hence it does not matter what the intervals are at which the chairs 11 are secured to the suspension and traction cable 1. Furthermore, the speed of the suspension and traction cable 1 and the location of the deflection pulley 2, if the latter is located on a clamping carriage, can be taken into account as well. It is thereby assured that the passengers who are to board a particular chair 11 will always have reached the entrance area as soon as that chair 11 arrives and approaches these passengers from behind.

Even if the cable pulley 2 is supported nondisplaceably, it is expedient to provide the second signal transducer 64, because it also acts, in cooperation with the first signal transducer 61 and the pulse transducer 62, to calibrate the control system by specifying a spacing X4 between the first signal transducer 61 and the second signal transducer 64. Since a speed measurement can also be made by means of the pulse transducer 62, the speed transducer 63 need not absolutely necessarily be provided.

I claim:

1. A cable car system, comprising:

a suspension and traction cable, passenger carriers suspended from said cable, a plurality of deflection pulleys about which said cable is deflected, a boarding area defining a boarding point at which passengers board said passenger carriers, a conveyor device disposed at said boarding area for conveying the passengers to said boarding point, an entrance gate disposed at said boarding area, and a central control unit connected to and controlling said entrance gate and said conveyor device;

a signal transducer connected to said central control unit for sensing said passenger carriers passing by said signal transducer and for issuing an output signal;

a speed transducer connected to said central control unit for detecting a travel speed of said cable and for issuing an output signal;

a measuring instrument for detecting a distance traveled by a respective said passenger carrier after having tripped said signal transducer; said central control unit opening said entrance gate as a function of the output signals received from said signal transducer and from said measuring instrument.

2. The cable car system according to claim 1, wherein said passenger carriers are lift chairs.

3. The cable car system according to claim 1, wherein said measuring instrument is a speed transducer.

4. The cable car system according to claim 1, wherein said measuring instrument is a pulse transducer.

5. The cable car system according to claim 1, wherein said signal transducer is disposed outside said boarding area.

6. The cable car system according to claim 5, wherein said signal transducer is disposed on a support of said cable car system outside a station building housing said boarding area.

7. The cable car system according to claim 1, which further comprises a drive motor driving said conveyor device, said drive motor being controlled by said central control unit.

8. The cable car system according to claim 1, wherein said measuring instrument is a feeler roller contacting said cable.

9. The cable car system according to claim 1, wherein said signal transducer is a first signal transducer, and a first one of said deflection pulleys is disposed in said boarding area, and wherein the cable car system further includes an adjustable clamping carriage for adjusting a position of said first deflection pulley, and a second signal transducer adjustably disposed by said clamping carriage, said second signal transducer sensing said passenger carriers passing by said second signal transducer and issuing an output signal to said central control unit.

10. The cable car system according to claim 1, which further comprises a photoelectric barrier preceding said entrance gate as seen in a direction in which the passengers enter the boarding area, said photoelectric barrier supplying a corresponding signal to said central control unit.

* * * * *

UNITED STATES PATENT AND TRADEMARK OFFICE

CERTIFICATE OF CORRECTION

PATENT NO. : 5,626,078
DATED : May 6, 1997
INVENTOR(S) : Elmar B. Fuchs

It is certified that error appears in the above-identified patent and that said Letters Patent is hereby corrected as shown below:

On the title page:

Item [30] should read as follows:

Apr. 7, 1995 [AT] Austria ..... A622/95

Signed and Sealed this

Sixth Day of January, 1998

Bruce Lehman

*Attest:*

BRUCE LEHMAN

*Attesting Officer*

*Commissioner of Patents and Trademarks*